US009343838B2

(12) United States Patent
Jové Albós

(10) Patent No.: US 9,343,838 B2
(45) Date of Patent: May 17, 2016

(54) METHOD FOR PRODUCING A SEALED CONNECTOR AND THE SEALED CONNECTOR OBTAINED

(71) Applicant: GJM, S.A., La Roca Del Vallès, Barcelona (ES)

(72) Inventor: Josep Jové Albós, Barcelona (ES)

(73) Assignee: GJM, S.A., La Roca del Valles (ES)

( * ) Notice: Subject to any disclaimer, the term of this patent is extended or adjusted under 35 U.S.C. 154(b) by 0 days.

(21) Appl. No.: 14/441,680

(22) PCT Filed: Jul. 17, 2013

(86) PCT No.: PCT/ES2013/070518

§ 371 (c)(1),
(2) Date: May 8, 2015

(87) PCT Pub. No.: WO2014/076333

PCT Pub. Date: May 22, 2014

(65) Prior Publication Data

US 2015/0280356 A1 Oct. 1, 2015

(30) Foreign Application Priority Data

Nov. 13, 2012 (EP) ..... 12382447

(51) Int. Cl.
*H01R 13/504* (2006.01)
*H01R 13/52* (2006.01)
(Continued)

(52) U.S. Cl.
CPC ..... *H01R 13/504* (2013.01); *H01R 13/5202* (2013.01); *H01R 13/5205* (2013.01); *H01R 43/005* (2013.01); *H01R 43/18* (2013.01);
(Continued)

(58) Field of Classification Search
CPC ..... H01R 13/504
See application file for complete search history.

(56) References Cited

U.S. PATENT DOCUMENTS 5,342,221 A 8/1994 Peterson
5,928,033 A * 7/1999 Kato ..... H01R 13/5205 174/77 R (Continued)

FOREIGN PATENT DOCUMENTS

DE 102011055215 A1 5/2012
EP 0 223 697 A1 11/1986

(Continued)

OTHER PUBLICATIONS

International Search Report from Application No. PCT/ES2013/070518; Dated Jan. 26, 2015.

(Continued)

*Primary Examiner* — James Harvey
(74) *Attorney, Agent, or Firm* — Pearne & Gordon LLP

(57) ABSTRACT

It comprises a first phase wherein cables (1) are connected to a base (2) with terminals (3, 3*a*), characterized in that it comprises a second phase wherein a protective element (4) is provided over at least a part of terminals (3*a*), which coincides with the part of the connector that is going to be overmolded, with said protective element (4) being welded to base (2) by ultrasound defining a sealed housing where at least said terminals (3*a*) are housed, and a third phase wherein the unit from the second phase is inserted into a mold and protective element (4), a part of base (2) and a part of cables (1) is overmolded, defining a predetermined overmolded outer shape (5) and sealing the cables-terminal unit.

10 Claims, 4 Drawing Sheets

(51) Int. Cl.
*H01R 43/00* (2006.01)
*H01R 43/18* (2006.01)
*H01R 43/24* (2006.01)

(52) U.S. Cl.
CPC ..... *H01R13/52* (2013.01); *H01R 43/24* (2013.01); *Y10T 29/49176* (2015.01)

(56) References Cited

U.S. PATENT DOCUMENTS 5,967,829 A * 10/1999 Shinchi ..... H01R 13/504 29/871
6,019,628 A * 2/2000 Shinchi ..... H01R 4/023 439/465
6,129,576 A 10/2000 Sakaguchi et al.
6,302,736 B1 * 10/2001 Nishio ..... H01R 13/504 439/404
6,485,325 B1 * 11/2002 Fukuda ..... H01R 13/504 439/465
6,517,368 B2 * 2/2003 Hara ..... H01R 13/521 439/271
6,716,056 B1 * 4/2004 Hsu ..... H01R 4/2429 439/406
2003/0224649 A1 12/2003 Vista, Jr. et al.
2012/0171887 A1 7/2012 Sebald et al.
2015/0280356 A1 * 10/2015 Jove Albos ..... H01R 13/504 439/587

FOREIGN PATENT DOCUMENTS

EP 1 439 615 A2 7/2004
EP 1 467 440 A1 10/2004
ES 1 051 490 U 8/2002

OTHER PUBLICATIONS

International Preliminary Report on Patentability from Application No. PCT/ES2013/070518; Dated May 19, 2015.

* cited by examiner

METHOD FOR PRODUCING A SEALED CONNECTOR AND THE SEALED CONNECTOR OBTAINED

Method for producing a sealed connector and the sealed connector obtained, of the type comprising a first phase in which cables are connected to a base with terminals, characterized in that it comprises a second phase wherein a protective element is provided over at least part of the terminals, which coincides with the part of the connector that is going to be overmoulded, with said protective element being welded to the base by ultrasound defining a sealed housing where at least said terminals are housed, and a third phase wherein the unit of the second phase is inserted into a mould and the protective element, a part of the base and part of the cables is overmoulded, defining a predetermined overmoulded outer shape and sealing the cables-terminals unit.

BACKGROUND OF THE INVENTION

Different connectors are known in the state of the art belonging to lamp holders with guaranteed sealing.

Thus, European Patent No. 1439615 "CONECTOR ELÉCTRICO (electrical connector), from 2004, in the name of AMPHENOL-TUCHEL ELECTRONICS GMBH, which relates to an electrical connector, particularly for its use between a power socket and an electrical control system for inflatable retention systems in cars, with the following characteristics: a casing for housing electrically connectable contact elements at the end of the plug-in side, retention means for holding the casing to the power socket, as well as an interlocking element that can be shifted axially towards the end of the plug-in side behind the retention means, characterized in that the interlocking element is surrounded in a non-positive way by a hose-like sealed body, which projects from the power socket in the plug-in state through the end of the plug-in side, and seals it with respect to the connector.

Also Spanish Utility Model No. 200200002 "CONJUNTO MODULO-CONECTOR ESTANCO (sealed module-connector unit), from 2001, in the name of LEAR AUTOMOTIVE (EEDS) SPAIN, S.L., which relates to a sealed module-connector unit, of the type used for the coupling between a connector body, that has a certain number of terminals with the same number of cables associated thereto, and a base body that also has terminals for connecting to those arranged in the connector body characterized in that the sealed module has at least three cavities or inlet routes and the same number of cavities or outlet routes intended to house electrical terminals and their cables, with an elastic band around the perimeter of the top of the module that confers it sealed conditions for when it is subsequently inserted into a connector body housing.

U.S. Pat. No. 6,129,576 "WATERPROOF STRUCTURE FOR ELECTRIC WIRE DRAWOUT PORTION AND METHOD OF MANUFACTURING THE SAME", from 1997 is known, in the name of YAZAKI CORPORATION, which relates to a connector that protects the cables from the damp by placing them in a housing that is sealed by ultrasound.

Also Patent No. DE102011055215 "(Kunststoff) während dem Umspritzprozess" from 2011 is known, in the name of HIRSCHMANN AUTOMOTIVE GMBH, which relates to a sealed connector which, in order to protect it from the damp, involves overmoulding the area of the cables, leaving said cables inside the sealed connector.

Along the same lines as the previous patent, we have U.S. Patent No. 2003/224649 "Protector for an overmolded connector", from the year 2002, in the name of P. Fidel Vista et al, which relates to a connector which, in order to increase its resistance to the damp and water, it involves overmoulding the cabling area, leaving said area watertight.

Lastly, also European Patent No. 0223697 "CONECTOR ELÉCTRICO ESTANCO PARA SER EMPLEADO EN INMERSION EN UN LÍQUIDO (sealed electrical connector for use in immersion in liquid), is known, from 1986, which comprises two elements that can be coupled mechanically to engage, in a two to two arrangement with electrical contacts provided in these elements, one of which has an open insulating body with longitudinal housings protecting the contacts and which is protected in an external box; means for shielding the element on an electrically bound cable with contacts including: a collar enclosing the cable's external joint and diametrically opposite radial projections; two semi-flanges surrounding the rear end of the insulating body and the area near the cable, where each projection is fitted into two respective internal notches of the semi-flanges, with axial joining and solidarizing means being provided in rotation, between the insulating body and the semi-flanges; and the semi-flange joining means.

BRIEF DESCRIPTION OF THE INVENTION

This invention is an improvement in the sector of electrical cabling for cars, to seal other vehicle elements.

The nearest document is German patent No. DE102011055215. This seeks the watertightness of the connector, in particular for cars, to prevent damage to these connectors from inclement weather conditions, such as rain. It does this by overmoulding the cables inside a housing, which seals said content from any possible water and/or damp entering from outside.

So, the inventor could see that mainly there was one problem which is that, even though the overmoulding solves the problem of watertightness, it damages the cables if the housing is not closed properly. This occurs because the cables are subject to the same overmoulding, either because the housing does not close properly, or because filtrations occur and said cables are damaged, whereby the economic losses are considerable as these connectors have to be rejected in the quality control stage.

Therefore the inventor considers a connector wherein initially the housing would be closed by ultrasounds, which would leave the overmoulding watertight, preventing said overmoulding from accessing inside the housing and damaging the cables.

Secondly the connector is overmoulded, leaving it watertight.

Another of the advantages is that only a few parts are used. The inventor could see that the need for a large amount of parts to produce the watertightness, increased costs and, as there were so many joints, there was always the possibility of filtration.

Also overmoulding with the desired shape reduces handling costs and at the same time this shape has no possible filtrations, thereby improving the watertightness.

Also, overmoulding according to the configuration and procedure described allows the connector to remain perfectly watertight, without any possibility of filtrations, which makes it ideal for situations like, for example a car headlamp, which is subject to the inclemencies of the weather.

An object of this invention is a method for producing a sealed connector and the sealed connector obtained, of the type comprising a first phase wherein cables are connected to a base with terminals, characterized in that it comprises a second phase wherein a protective element is provided over at least one part of the terminals, which coincides with the part of the connector that is going to be overmoulded, with said protective element being welded to the base by ultrasound defining a sealed housing where at least said terminals are housed, and a third phase wherein the unit of the second phase is inserted into a mould and the protective element, a part of the base and a part of the cables is overmoulded, defining a predetermined overmoulded shape and sealing the cables-terminals unit.

An additional object of the invention is a sealed connector according to the method above of the type comprising at least one cable connected to a base with terminals, characterized in that it comprises a protective element over at least one part of the terminals, which coincides with the part of the overmoulded connector, with said protective element being welded to the base by ultrasound defining a sealed housing where at least said terminals are housed, and an overmoulding layer that overmoulds the protective element, a part of the base and a part of the cables, defining a predetermined overmoulded outer shape and sealing the cables-terminals unit.

BRIEF DESCRIPTION OF THE DRAWINGS

In order to facilitate the explanation, four sheets of drawings are attached to the present description that shows a practical embodiment case, which is cited as a non-limiting example to the scope of this invention.

SPECIFIC EMBODIMENT OF THE INVENTION

Figure 1:
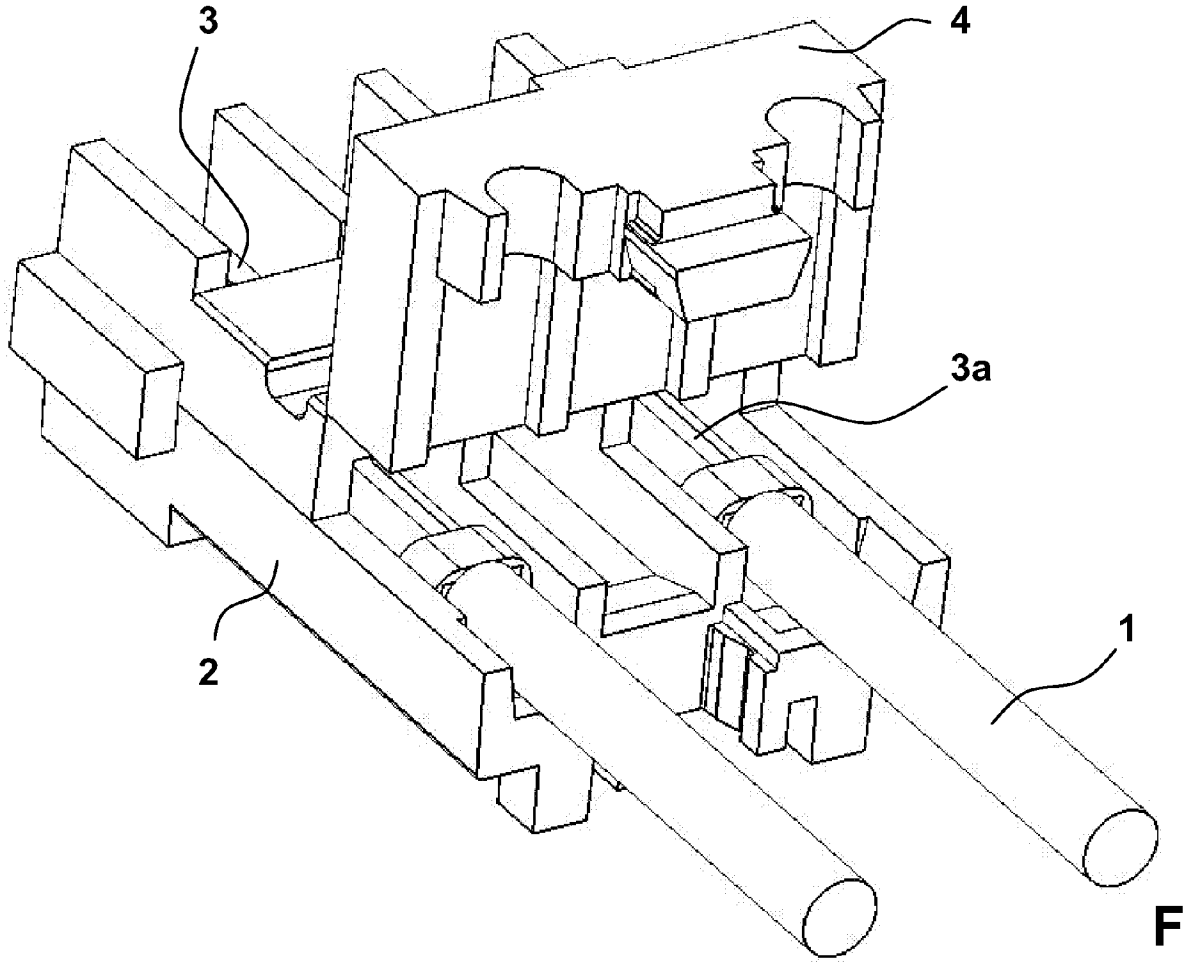
FIG. 1 is a front elevation view.

This way, FIG. 1 shows cables 1, a base 2, terminals 3, a protective element 4 and terminals free of the overmoulding 3*a* after the method has been used.

Figure 2:
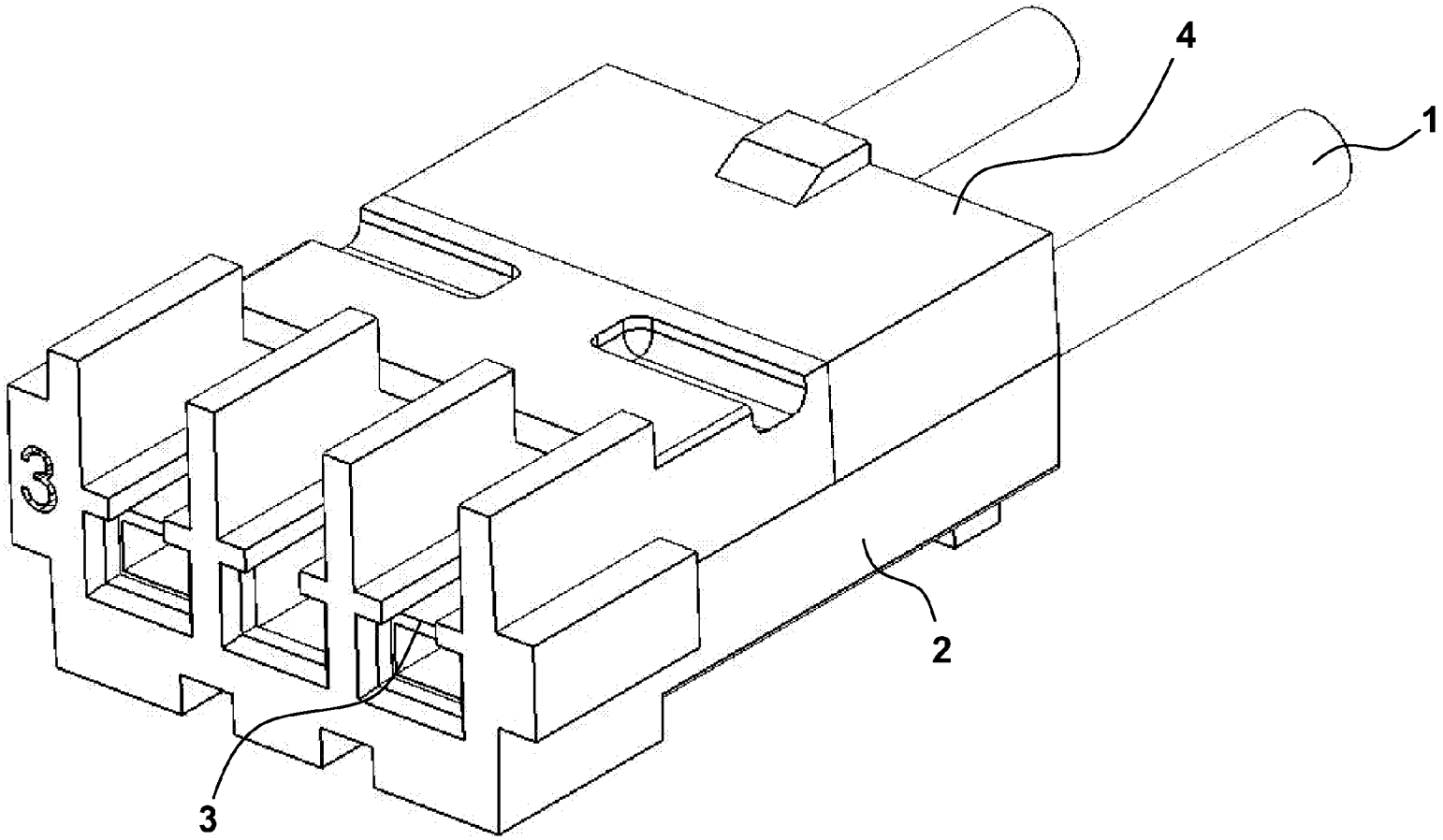
FIG. 2 is a rear side perspective view.

FIG. 2 illustrates the cables 1, base 2, terminals 3 and protective element 4.

Figure 3:
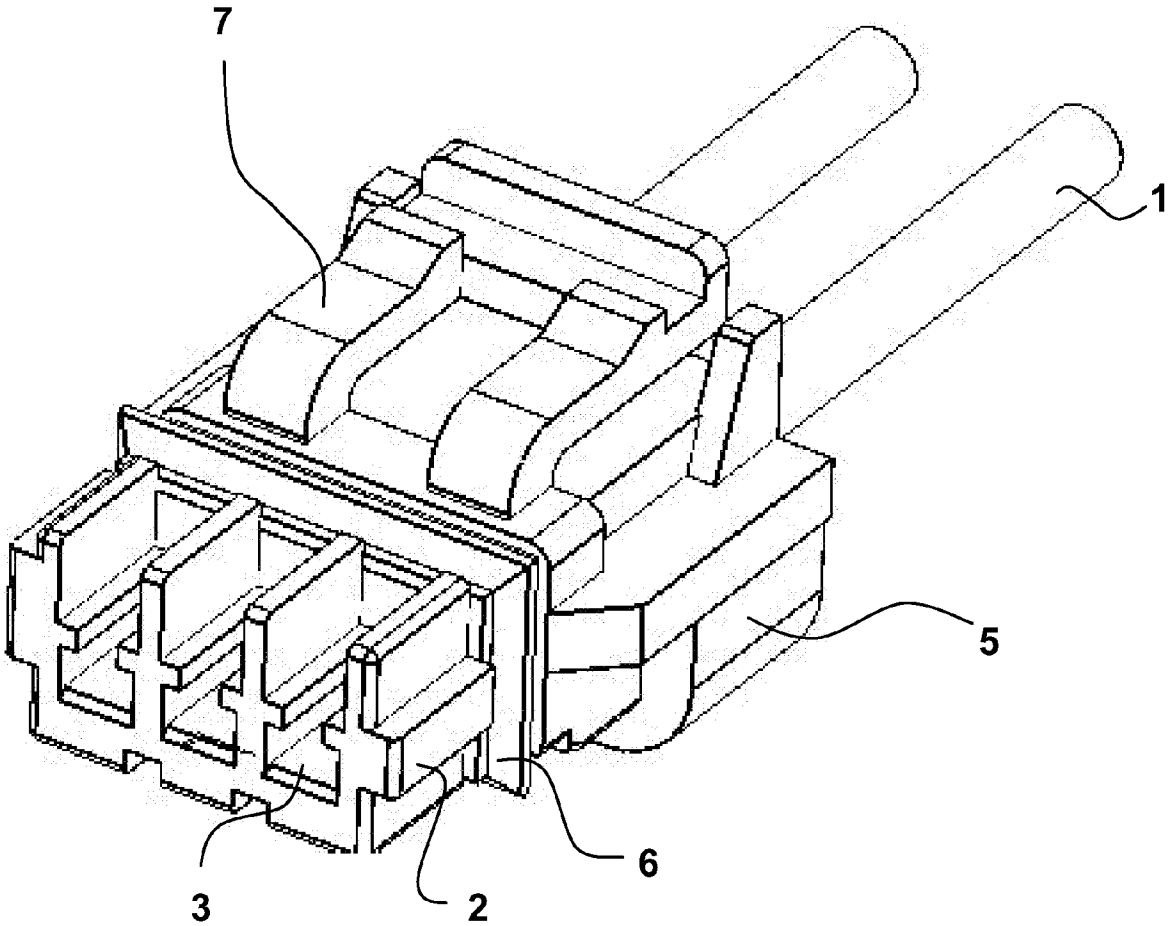
FIG. 3 is a side perspective view of FIG. 2 with the overmoulding.

FIG. 3 illustrates cables 1, base 2, terminals 3, protective element 4, an overmoulding 5 with a retention means 7 and a sealing material 6.

Figure 4:
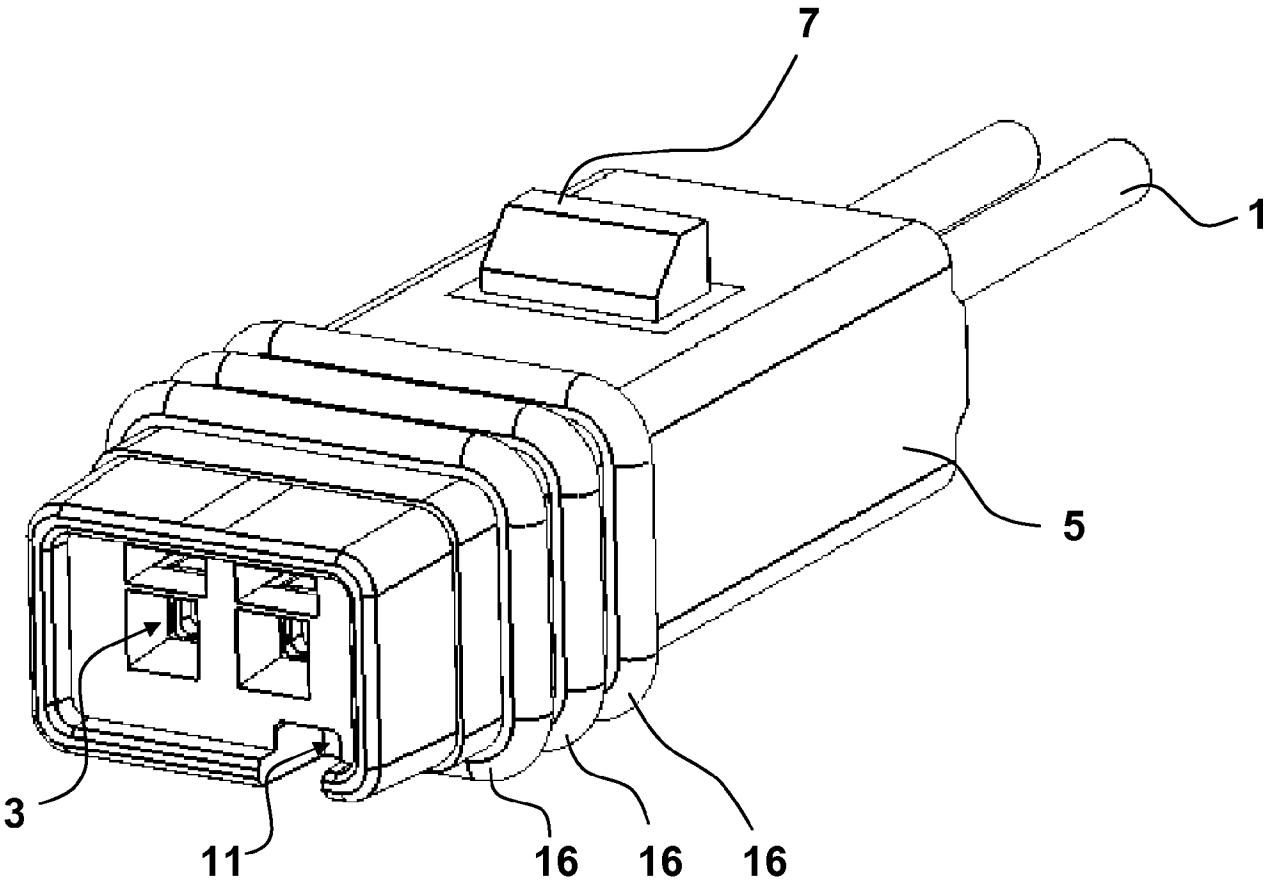
FIG. 4 is a side perspective view with another external embodiment.

Finally, FIG. 4 shows cables 1, terminals 3, overmoulding 5 with retention means 7, sealing material 16 and a polarising element 11.

So, in a specific embodiment, the method for producing a sealed connector would include initially the following phases:

In a first phase cables 1 are connected with terminals 3, 3*a* to base 2 of the connector, as shown in FIG. 1.

The base may be different with a different shape.

Subsequently in a second phase (FIG. 2) wherein a protective element (4) is provided over at least part of terminals (3*a*), which coincides with the part of the connector that is going to be overmoulded. Then said protective element 4 is welded to base 2 by ultrasound defining a sealed housing where at least said terminals 3*a* are housed. This is done to protect said terminals from the overmoulding damaging their characteristics.

The inventor could test that the welding by ultrasound losses efficiency, and water finally enters, this is the reason that the inventor chooses the overmoulding. But, at the same time, before the overmoulding, the inventor has found in affirmative manner that secures that the overmoulding, while it is in a fluid stage, it will not enter in contact with the terminals 3*a*. After, when the overmoulding solidifies, there is no danger that the overmoulding enters in contact with the terminals 3*a*.

Protective element 4 can be hinged to base 2 as shown in FIG. 1, making it easier to fit protective element 4 when it is welded, or protective element 4 can be a completely loose part.

Lastly in the third phase (FIG. 3) the unit shaped in the second phase is inserted into a mould. Then protective element 4, a part of base 2 and a part of cables 1 are overmoulded, thereby shaping a predetermined overmoulded external shape 5 and sealing the cables-terminal unit.

By overmoulding this way, cables 1 do not lose connectivity with terminals 3 and it prevents water and other corrosive agents from penetrating inside the connector.

Optionally a fourth phase can be provided wherein a sealed gasket 6 (FIG. 3) is added, that surrounds the end area of the overmoulding 5 defining the free terminals 3 of overmoulding 5. This increases the connector's seal, with the receiving part thereof, preventing erosive agents from entering terminals 3*a*.

As shown in FIG. 4, there is the option that said seal be formed by a succession of joints 16, arranged from the smallest to the biggest seen from terminals 3, so that the adaptation of the last joint to the corresponding negative, prevents any possible inlet of water through this area, and at the same time acts as an additional attachment system.

There is also the possibility that by overmoulding retention means 7 can be provided. These retention means 7, for example a flexible tab (FIG. 3) or a nail (FIG. 4), are used to retain this part in the receiving part of the unit, thereby preventing it from working loose through vibration and making sure that the parts have a correct electrical connection, as it is part of the same overmoulding material 5.

Also, optionally, there is the possibility that the connector comprises a polarising element 11 that is used to be able to recognise the particular side in order to be able to install the connector, for example, if various connectors are found and this way it is possible to recognise the one belonging to the right side, left side, etc.

The advantage of overmoulding 5 also lies in that depending on the desired external shape, by changing or modifying the mould, bespoke external shapes are obtained.

The overmoulding is to be a plastics material, for example nylon or polypropylene.

So the sealed connector that is the object of the method above comprises at least one cable 1, in this embodiment two cables (although there could be more), connected to a base 2 with terminals 3, 3*a*.

It also comprises a protective element 4 over at least a part of terminals 3, which coincides with the part of the overmoulded connector. Said protective element 4 is welded to base 2 by ultrasound. This forms a sealed housing where at least terminals 3*a* are housed. As indicated above, this is done to protect said terminals 3*a* against the overmoulding damaging their characteristics.

As it was explained previously, the inventor could check that after some time the welding by ultrasounds loses efficiency or effectiveness, losing its sealing characteristics, causing that water enters, and for this reason, in this invention the welding by overmoulding is the chosen option. But at the same time, as a timely welding, and before the overmoulding, the inventor could test that the welding by ultrasounds assures that the overmoulding, while it is in fluid stage, will not enter in contact with terminals 3*a*. After, when the overmoulding solidifies, there is no danger that enters in contact with terminals 3*a*.

Then, said combination of overmoulding and ultrasounds allows to assure that the terminals 3*a* are always tighted, as well as water or different agents, as the same overmoulding.

Protective element 4 can be hinged to base 2 as shown in FIG. 1 or protective element 4 can be a completely loose part.

The overmoulding layer 5 overmoulds protective element 4, a part of base 2 and a part of cables 1, as shown in FIG. 3, defining a predetermined external shape and sealing the cables-terminal unit.

Optionally the connector can comprise a sealing material or sealed gasket 6 that surrounds the end part of overmoulding 5 which prevents water entering the overmoulding part and the receiving part, for example for connecting to a car head lamp.

As shown in FIG. 4 there is the option that said joint be made up of a succession of joints 16, arranged from the smallest to the biggest seen from terminals 3. This means that the adaptation of the last joint to the corresponding negative prevents the possible inlet of water through this area and at the same time it acts as an additional attachment system of the negative to the headlamp, for example, or to the place where it is to be attached.

The connector, in overmoulding 5 comprises a retention means 7, for example an elastic tab or a nail which, as explained above, is for attaching it to the receiving part ensuring good electrical contact and avoiding the false joint which can disconnect from the receiving part through vibration.

Also, optionally, there is the possibility that the connector comprises a polarising element 11. This is used to be able to recognise by simply feeling the particular side in order to be able to install the connector, for example, if various connectors are found and this way it is possible to recognise the one belonging to the right side, the left side, etc.

This patent of invention describes a new method for producing a sealed connector and the sealed connector obtained. The examples mentioned herein are non-limiting with respect to this invention and therefore said invention can have different applications/adaptations, all within the scope of the following claims.

The invention claimed is:

1. Method for producing a sealed connector, of the type comprising the step of:

a first phase wherein cables are connected to a base with terminals, characterized in that the method further comprises the steps of:

a second phase wherein a protective element is provided over at least one part of terminals, which coincides with a part of the connector that is going to be overmoulded, with said protective element being welded to base by ultrasound defining a sealed housing where at least said terminals are housed, and a third phase wherein the unit from the second phase is inserted into a mould and protective element, a part of base and a part of cables is overmoulded, defining a predetermined overmoulded external shape and sealing the the part of the cables, the protective element and the part of the base.

2. Method, according to claim 1, characterized in that the method further comprises the step of a fourth phase wherein a sealed gasket is applied that surrounds an end area of the overmoulding.

3. Method, according to claim 1, characterized in that overmoulding comprises a retention means.

4. Method, according to claim 1, characterized in that protective element is hinged to base.

5. Method, according to claim 1, characterised in that the sealed connector comprises a polarising element.

6. Sealed connector, produced according to the method of the above claim 1 of the type comprising:

at least one cable connected to a base with terminals, characterized in that it the sealed connector comprises:

a protective element over at least a part of terminals, which coincides with the part of the overmoulded connector, with said protective element being welded to base by ultrasound defining a sealed housing where at least said terminals are housed; and an overmoulding layer that overmoulds protective element, a part of base and a part of cables, defining a predetermined external shape and sealing the cables-terminal unit.

7. Sealed connector, according to claim 6, characterized in that the sealed connector further comprises a sealed gasket surrounding an end part of overmoulding.

8. Sealed connector, according to claim 6, characterized in that overmoulding comprises a retention means.

9. Sealed connector, according to claim 6, characterized in that protective element is hinged to base.

10. Sealed connector, according to claim 6, characterised in that it the sealed connector comprises a polarising element.

* * * * *